US010233599B2

(12) United States Patent
Muir et al.

(10) Patent No.: US 10,233,599 B2
(45) Date of Patent: Mar. 19, 2019

(54) MILLING MACHINE

(71) Applicant: Caterpillar Paving Products Inc., Minnesota, MN (US)

(72) Inventors: Jason William Muir, Andover, MN (US); Roger Hedlund, Champlin, MN (US); Joseph F Carter, Blaine, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/673,729

(22) Filed: Aug. 10, 2017

(65) Prior Publication Data

US 2019/0048536 A1 Feb. 14, 2019

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/30* (2013.01)

(58) Field of Classification Search
CPC ..... E21C 25/00; E01C 23/088; E01C 2301/30
USPC ..... 180/89.12; 296/146.15, 200, 190.1
See application file for complete search history.

(56) References Cited

U.S. PATENT DOCUMENTS 2,479,036 A * 8/1949 Campbell ..... B62D 33/0621 296/102
7,540,685 B2 6/2009 Avikainen et al.
7,753,620 B2 * 7/2010 Kotting ..... E01C 19/004 299/39.4
2008/0258535 A1 * 10/2008 Berning ..... B62D 33/0636 299/39.4

FOREIGN PATENT DOCUMENTS

GB 2244746 A * 12/1991

* cited by examiner

*Primary Examiner* — Sunil Singh
(74) *Attorney, Agent, or Firm* — Bookoff McAndrews

(57) ABSTRACT

A milling machine includes a frame, a milling chamber, a rotor, an enclosed operator cab. The frame has a first lateral side and a second lateral side. The first lateral side corresponds to a flush cut side of the milling machine. The milling chamber is supported by the frame and extends beyond the first lateral side in a lateral direction of the milling machine. The rotor is positioned within the milling chamber to grind a work surface. The enclosed operator cabin is mounted on the frame, and includes a seat for an operator of the milling machine disposed inside the enclosed operator cabin, and a viewing window that is positioned laterally outside the first lateral side of the frame. The viewing window is configured to provide a direct line of sight of the milling chamber to the operator seated on the seat.

20 Claims, 8 Drawing Sheets

MILLING MACHINE

TECHNICAL FIELD

The present disclosure relates to a milling machine. More particularly, the present disclosure relates to a milling machine with an enclosed operator cabin that provides a line of sight of a milling chamber to an operator of the milling machine.

BACKGROUND

Asphalt-surfaced roadways are widely used for vehicular travel. Depending upon the extent and type of usage, asphalt density, age, base conditions, and environmental variables such as temperature and moisture the asphalt surface can become misshapen, non-planar, unable to support wheel loads or otherwise unsuitable for vehicular traffic. In order to rehabilitate roadways, parking lots or other surfaces, a variety of machines are often used in the paving industry for surface treating, for removing, mixing, recycling, laying and compacting of asphalt, soil and other road materials. Also, in some instances machines may utilized for stabilization or reclamation of soil in which additives are mixed with the soil for improving load bearing capability of a ground before paving the ground.

Various features such as curbs, lampposts, potholes, manholes, curves in the work surface, etc. typically require the operator to have a good line of sight to the material surface being worked and thus a milling chamber of the machine. In some cases, operators may steer widely around such features to ensure the work machine will not strike them. While this approach can prevent damage to the equipment, operating efficiency and work quality may be reduced due to regions of unprocessed work material. Traditionally, the operator can improve visibility of the milling chamber by standing up out of the seat, and peering over the side of the machine as much as possible to view the ground. This technique has various drawbacks, as the operator must continue to control machine operation, and may tire of twisting and turning in the seat.

SUMMARY OF THE INVENTION

In one aspect, the disclosure relates to a milling machine. The milling machines includes a frame, a milling chamber, a rotor, an enclosed operator cab. The frame has a first lateral side and a second lateral side. The first lateral side corresponds to a flush cut side of the milling machine. The milling chamber is supported by the frame and extends beyond the first lateral side in a lateral direction of the milling machine. The rotor is positioned within the milling chamber to grind a work surface. The enclosed operator cabin is mounted on the frame, and includes a seat for an operator of the milling machine disposed inside the enclosed operator cabin. Further, the enclosed operator cabin includes a viewing window that is positioned laterally outside the first lateral side of the frame. The viewing window is configured to provide a direct line of sight of the milling chamber to the operator seated on the seat.

In another aspect, the disclosure relates to a milling machine. The milling machine includes a frame, a milling chamber, a rotor, and an enclosed operator cabin. The frame has a first lateral side that corresponds to a flush cut side of the milling machine, and further includes a second lateral side. The milling chamber is supported by the frame and extends beyond the first lateral side in a lateral direction of the milling machine. The rotor is positioned within the milling chamber to grind a work surface. Further, the enclosed operator cabin slidably is mounted on the frame to slide along the lateral direction of the milling machine. The enclosed operator cabin includes a seat for an operator of the milling machine disposed inside the enclosed operator cabin. Further, the enclosed operator cabin includes a base structure engaged with the frame of the milling machine. A first side structure of the enclosed operator cabin extends from the base structure, and is disposed towards the flush cut side of the milling machine. The first side structure includes an angled portion defining a viewing window and forming an obtuse angle relative to the base structure. The viewing window is configured to extend outboard of the first lateral side of the frame to provide a direct line of sight of the milling chamber to the operator seated on the seat.

In yet another aspect, the disclosure relates to an enclosed operator cabin for a milling machine. The milling machine includes a frame having a first lateral side that corresponds to a flush cut side of the milling machine, a milling chamber that is supported by the frame, and a rotor positioned within the milling chamber to grind a work surface. The enclosed operator cabin includes a base structure, a seat, and a first side structure. The base structure is configured to be engaged with the frame. The seat for an operator of the milling machine is disposed inside the enclosed operator cabin. The seat is coupled to the base structure. Moreover, the first side structure extends from the base structure, and is configured to be disposed towards the flush cut side of the milling machine. The first side structure includes an angled portion defining a viewing window. The angled portion forms an obtuse angle relative to the base structure. The viewing window is configured to extend outboard of the first lateral side to provide a direct line of sight of the milling chamber to an operator seated on the seat.

DETAILED DESCRIPTION

Figure 1:
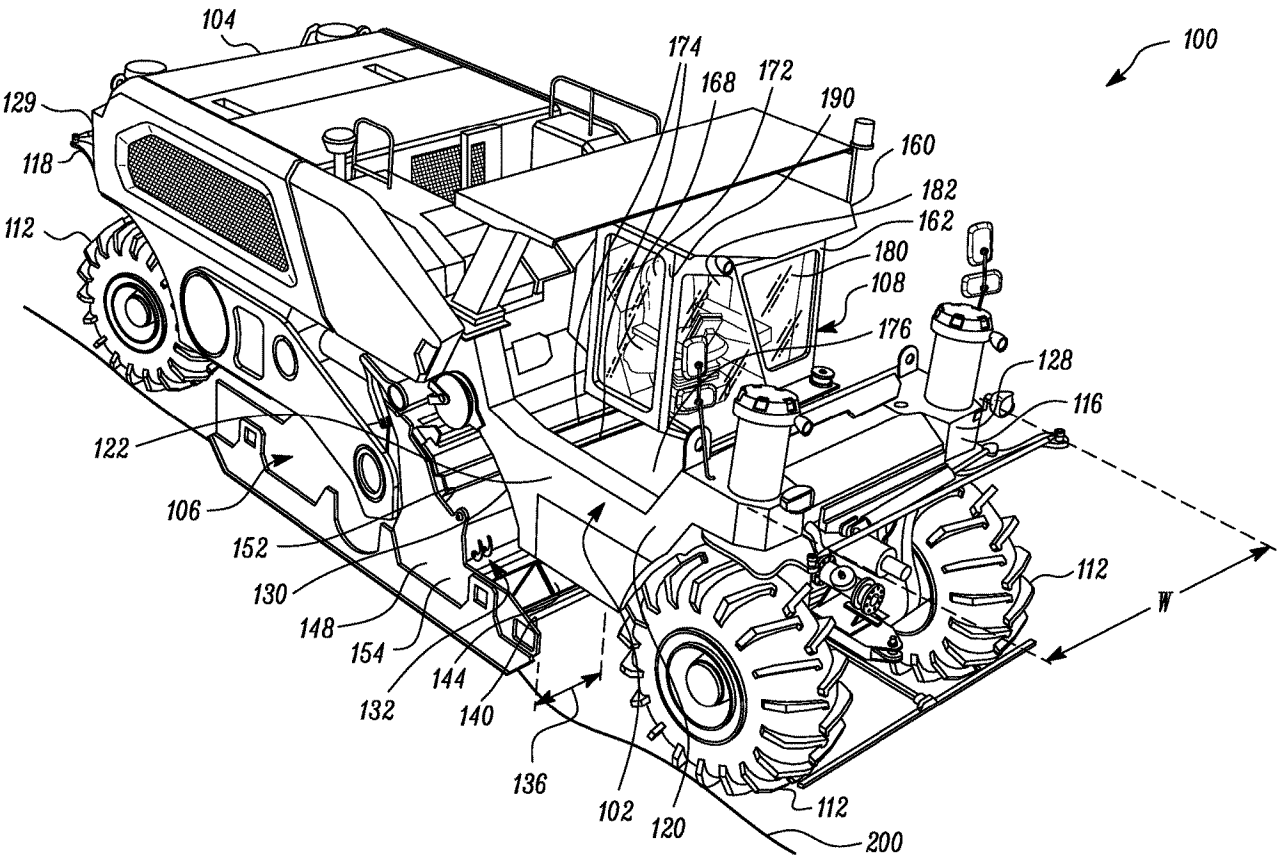
FIG. 1 illustrates a perspective view of a milling machine having an enclosed operator cabin, and depicting a flush cut side of the milling machine, in accordance with an embodiment of the present disclosure.
Figure 2:
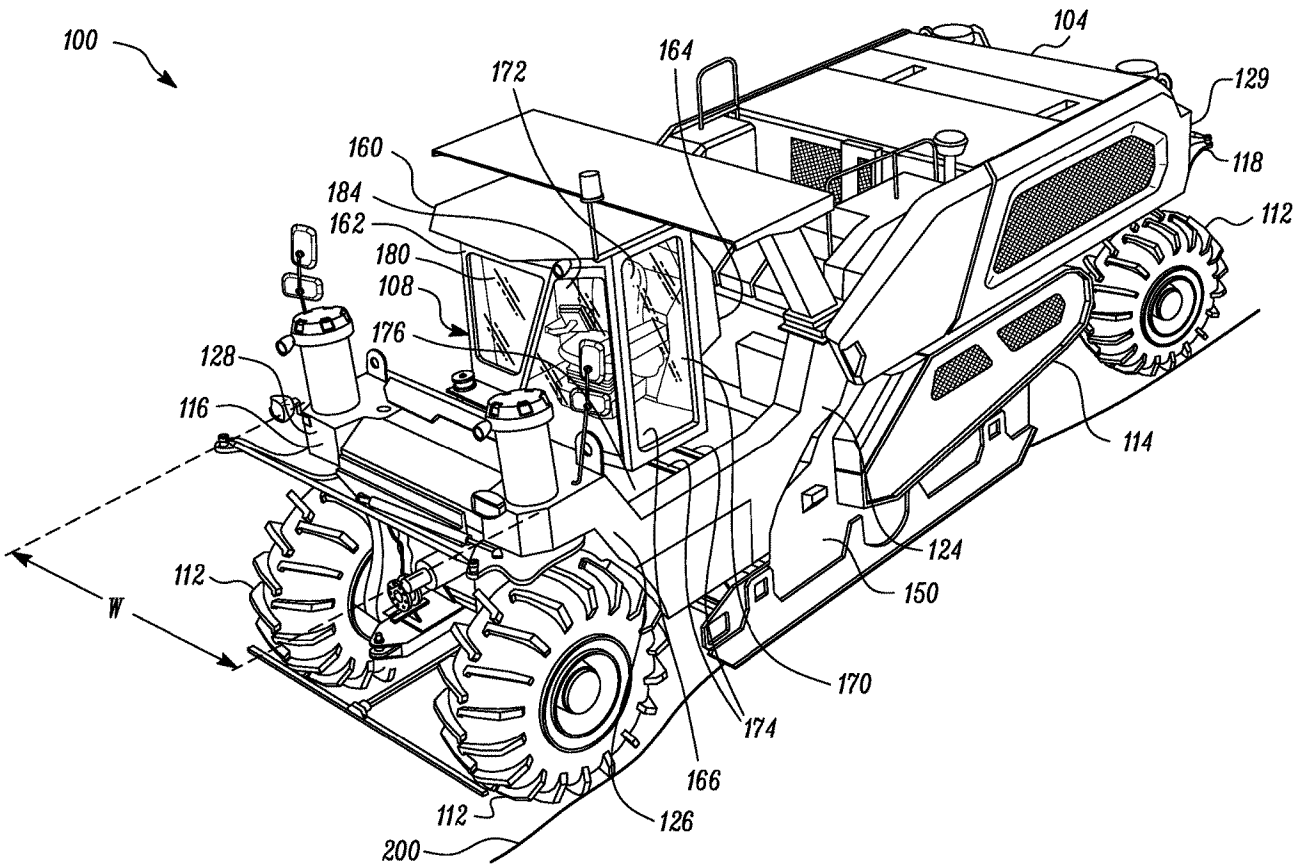
FIG. 2 illustrates a perspective view of the milling machine having the enclosed operator cabin, and depicting a non-flush cut side of the milling machine, in accordance with an embodiment of the present disclosure.

Referring to FIG. 1, a milling machine 100 is disclosed. The milling machine 100 may be a rotary mixer (shown in FIG. 1), a recycler, a cold planer, or any other milling machine, configured to grind or pulverize a work surface 200. In an embodiment, the work surface 200 may be a paved surface such as a road surface. Alternatively, the work surface 200 may be a non-paved surface. In an embodiment, additives may be mixed with the grounded and/or pulverized material, during grinding and/or pulverization, for stabilizing a soil or a layer of the work surface 200. Referring to FIGS. 1 to 5, the milling machine 100 may include a frame 102, an engine compartment 104, a milling assembly 106, an enclosed operator cabin 108 (also referred as cab 108), a rotor 110 (shown in FIG. 5), a plurality of traction units 112, and a drive assembly 114 (shown in FIG. 2 and FIG. 4) for driving the rotor 110. The frame 102 includes a front end 116 and a rear end 118, and acts as a support or mounting structure for various components or systems or assemblies, for example, the engine compartment 104, the milling assembly 106, the cab 108, the rotor 110, the traction units 112, the drive assembly 114, etc. The frame 102 further includes a first lateral side 120 that corresponds to a flush cut side 122 of the milling machine 100, and a second lateral side 124 (shown in FIG. 2 and FIG. 4) that corresponds to a non-flush cut side 126 of the milling machine 100. Further, the front end 116 of the frame 102 corresponds to a front end 128 of the milling machine 100, and the rear end 118 of the frame 102 corresponds to a rear end 129 of the milling machine 100. The frame 102 further includes a width 'W' between the first lateral side and the second lateral side along a lateral direction of the milling machine 100.

The engine compartment 104 may be disposed proximate to the rear end 118 of the frame 102 relative to the front end 116, and may be coupled to the frame 102. Thus, the engine compartment 104 may be disposed proximate to the rear end 129 of the milling machine 100 relative to the front end 128 of the milling machine 100. The engine compartment 104 may house an engine (not shown) of the milling machine 100. The engine may be connected to and supported by the frame 102, and may be configured to electrically, mechanically, hydraulically and/or pneumatically power the traction units 112, the rotor 110, and various other systems of the milling machine 100. The traction units 112 are connected to the frame 102, and receive a power from the engine to propel the milling machine 100. As shown, two traction units 112 are supported at the front end 116 of the frame 102, and the two traction units 112 are supported at the rear end 118 of the frame 102. Although traction units 112 are depicted as wheels, it is to be understood that other devices, such as but not limited to tracks or the like may also be employed.

The milling assembly 106 may be disposed below the frame 102, and may be coupled to a bottom side 130 of the frame 102. In an embodiment, the milling assembly 106, at least partly, may be disposed between the engine compartment 104 and the front end 116 of the frame 102 along a longitudinal direction of the milling machine 100. The milling assembly 106 includes a milling chamber 132 and the rotor 110 (shown in FIG. 5) disposed/positioned within the milling chamber 132. The rotor 110 may include a plurality of cutting elements 134 mounted on an outer periphery of a rotor drum to grind and/or pulverize the work surface 200. In an embodiment, additives may be mixed with the grounded and/or pulverized material, during grinding and/or pulverization, for stabilizing a soil or a layer of the work surface 200. The rotor 110 may be driven by the drive assembly 114 which in turn may be driven by the engine. The drive assembly 114 may be disposed on the non-flush cut side 126 of the milling machine 100, and may be coupled to the second lateral side 124 of the frame 102. The drive assembly 114 may include a chain sprocket arrangement to rotate the rotor 110. Although, the chain sprocket arrangement is contemplated, it may be appreciated that the drive assembly 114 may include a belt pully arrangement, a gear assembly, or any other suitable mechanism to transfer power from the engine for rotating/driving the rotor 110.

The milling chamber 132 is supported by the frame 102, and extends beyond or outwardly from the first lateral side 120 of the frame 102 in a lateral direction of the milling machine 100 to define a gap 136 between an edge 140 of the milling chamber 132 and the frame 102. Similarly, the milling chamber 132 may also extend beyond the second lateral side 124 of the frame 102 in the lateral direction of the milling machine 100. Thus, in an embodiment, a width of the milling chamber 132 may be greater than the width 'W' of the frame 102. Further, the milling chamber 132 is disposed at least partly between the cab 108 and the engine compartment 104.

The milling chamber 132 may include a front gate 144, a rear gate 146, a first side plate 148 disposed on the flush cut side 122 of the milling machine 100, and a second side plate 150 disposed on the non-flush cut side 126 of the milling machine 100. The first side plate 148 defines the edge 140 of the milling chamber 132, and includes an inner surface 152 and an outer surface 154. In an embodiment, the inner surface 152 of the first side plate 148 defines the edge 140 of the milling chamber 132. The first side plate 148 may be positioned at a lateral distance from the first lateral side 120 of the frame 102 to define the gap 136 between the edge 140 of the milling chamber 132. The gap 136 provides an opening through which an operator of the milling machine 100 is able to see the milling chamber 132, and therefore, the edge 140 of the milling chamber 132.

The cab 108 is an enclosed structure, and includes a roof structure 160, a front structure 162, a back structure 164, a base structure 166, a first side structure 168, and a second side structure 170 to form the enclosed structure. The cab 108 is mounted on the frame 102, and is disposed proximal to the front end 116 of the frame 102. Thus, the cab 108 may be disposed/positioned proximate to the front end 128 of the milling machine 100 relative to the rear end 129 of the milling machine 100. The cab 108 is mounted on the frame 102 such that the base structure 166 is engaged with the frame 102. In an implementation, the cab 108 may be disposed on the frame 102 such that the milling chamber 132, at least partly, is disposed between the engine compartment 104 and the cab 108 in the longitudinal direction of the milling machine 100. In an embodiment, the cab 108 may be mounted on the frame 102 of the milling machine 100 such that a portion of the cab 108 extends directly above the milling chamber 132. Therefore, at least a portion of the milling chamber 132 may extend directly below a portion of the cab 108, and thus the portion of the milling chamber 132 overlaps the portion of the cab 108 in the longitudinal direction of the milling machine 100. The cab 108 also includes a seat 172 for the operator of the milling machine 100. The cab 108 is configured to house a display, a steering wheel, one or more control levers to operate various functions of the milling machine 100, and the seat 172 disposed inside the cab 108. The seat 172 may be coupled to the base structure 166 of the cab 108, and may swivel relative to the base structure 166 in both clockwise and counter-clockwise directions from a central position. The seat 172 may be configured to swivel approximately 90 degrees from the central position in both clockwise and counter-clockwise direction. The center position refers to a position of the seat 172 which is maintained for viewing a front of the milling machine 100, during travelling.

Figure 3:
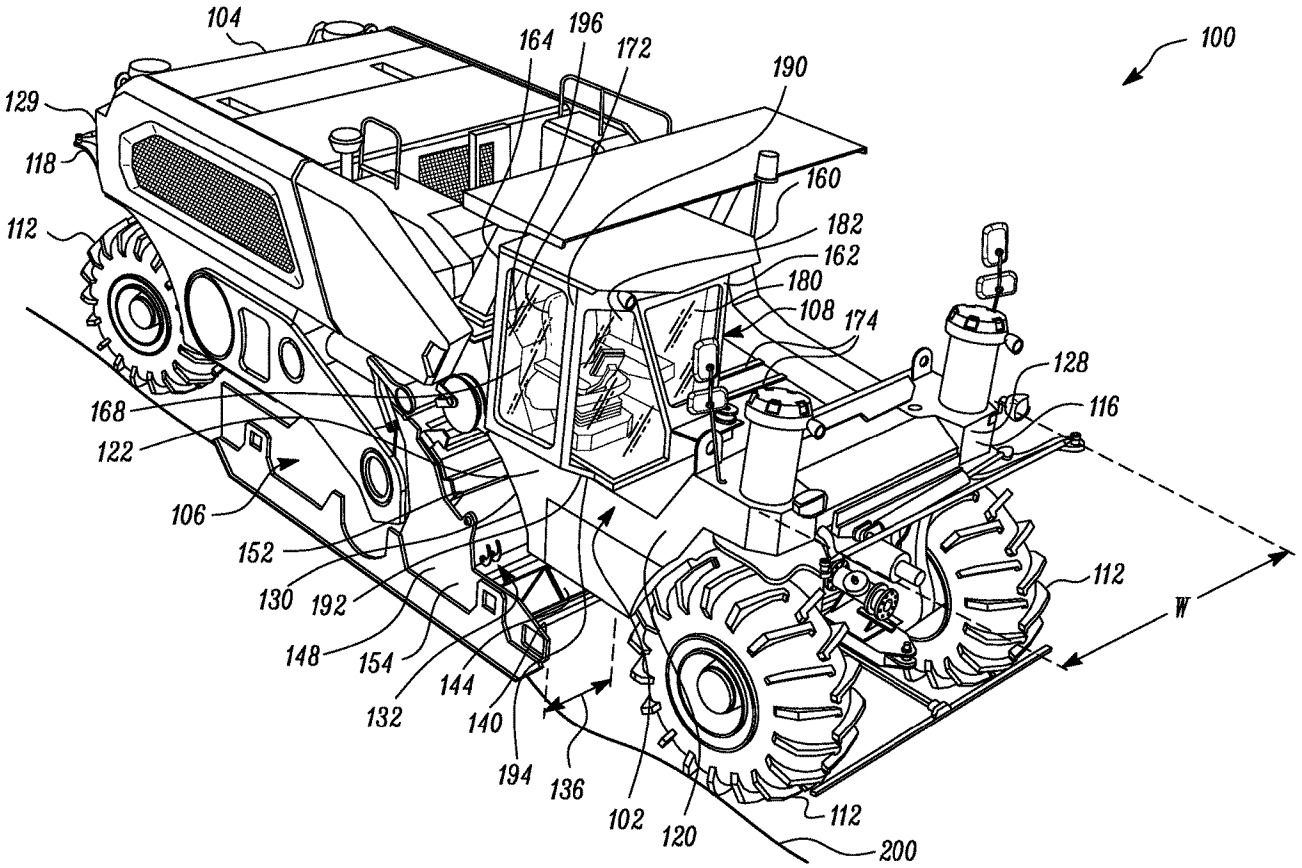
FIG. 3 illustrates a perspective view of a milling machine having the enclosed operator cabin positioned at a first position, and depicting the flush cut side of the milling machine, in accordance with an embodiment of the present disclosure.
Figure 4:
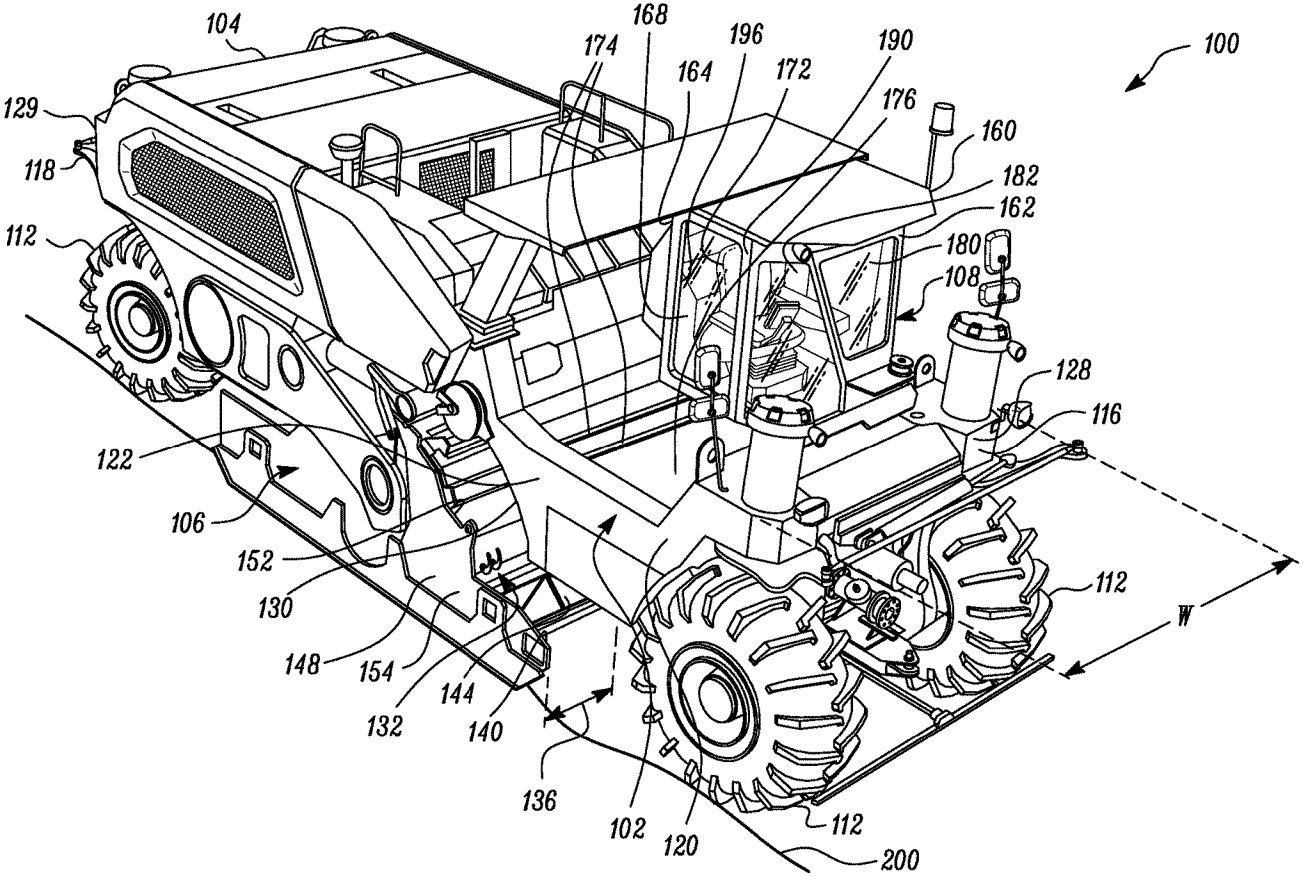
FIG. 4 illustrates a perspective view of a milling machine having the enclosed operator cabin positioned at a second position, and depicting the non-flush cut side of the milling machine, in accordance with an embodiment of the present disclosure.
Figure 5:
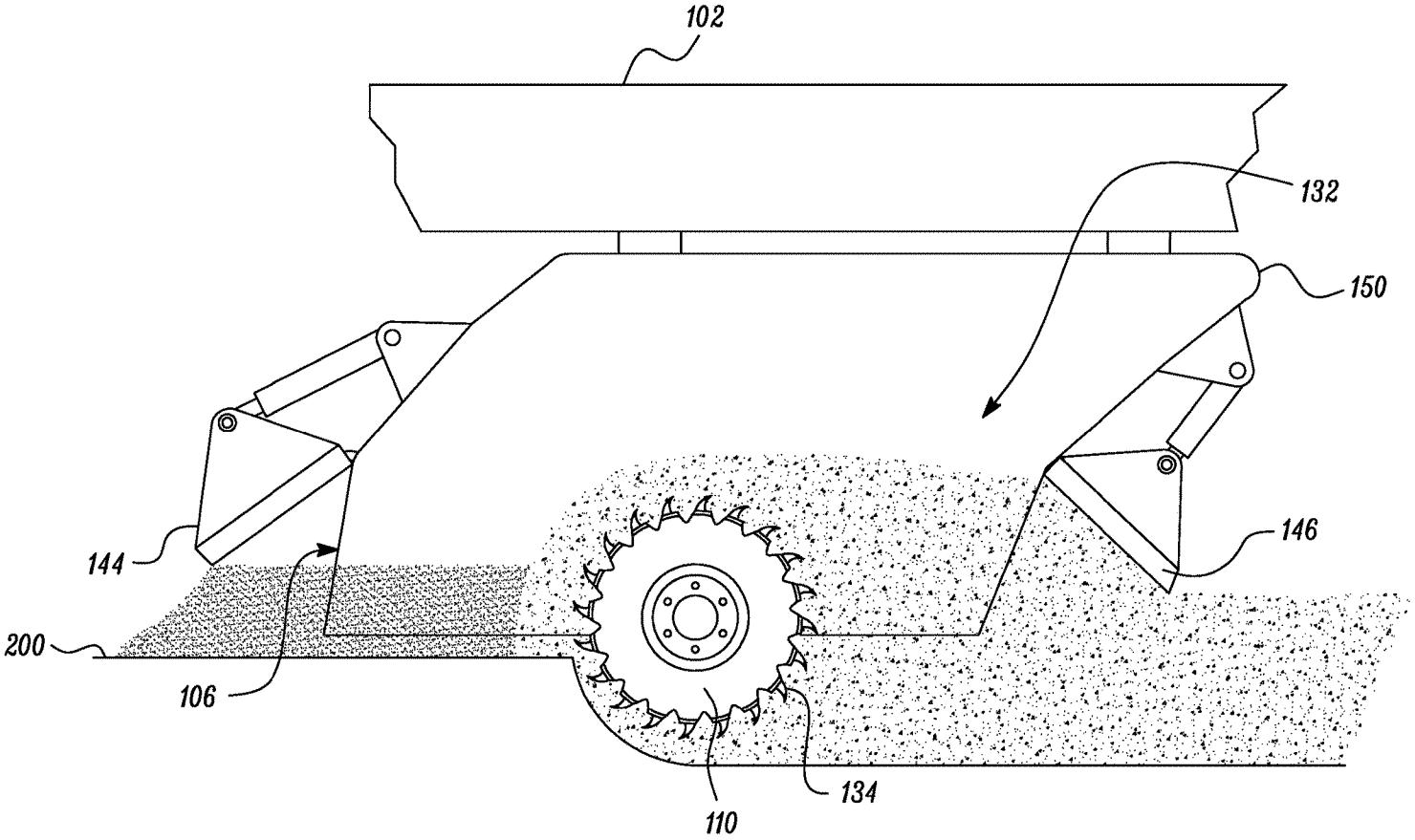
FIG. 5 illustrates a milling assembly of the milling machine depicting a rotor inside a milling chamber, in accordance with an embodiment of the present disclosure.
Figure 6:
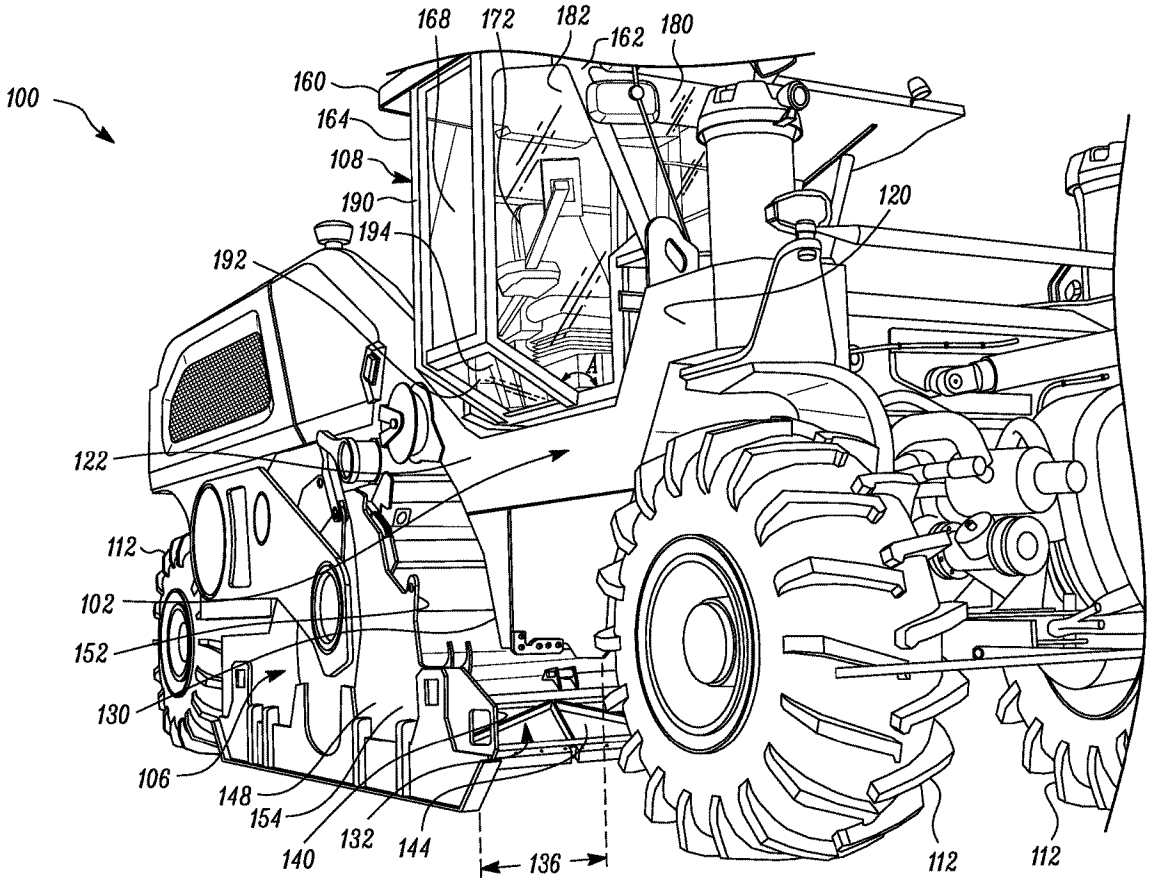
FIG. 6 illustrates another view of the flush cut side of the milling machine with the enclosed operator cabin at the first position, and depicting a viewing window of the enclosed operator cabin, in accordance with an embodiment of the present disclosure.
Figure 7:
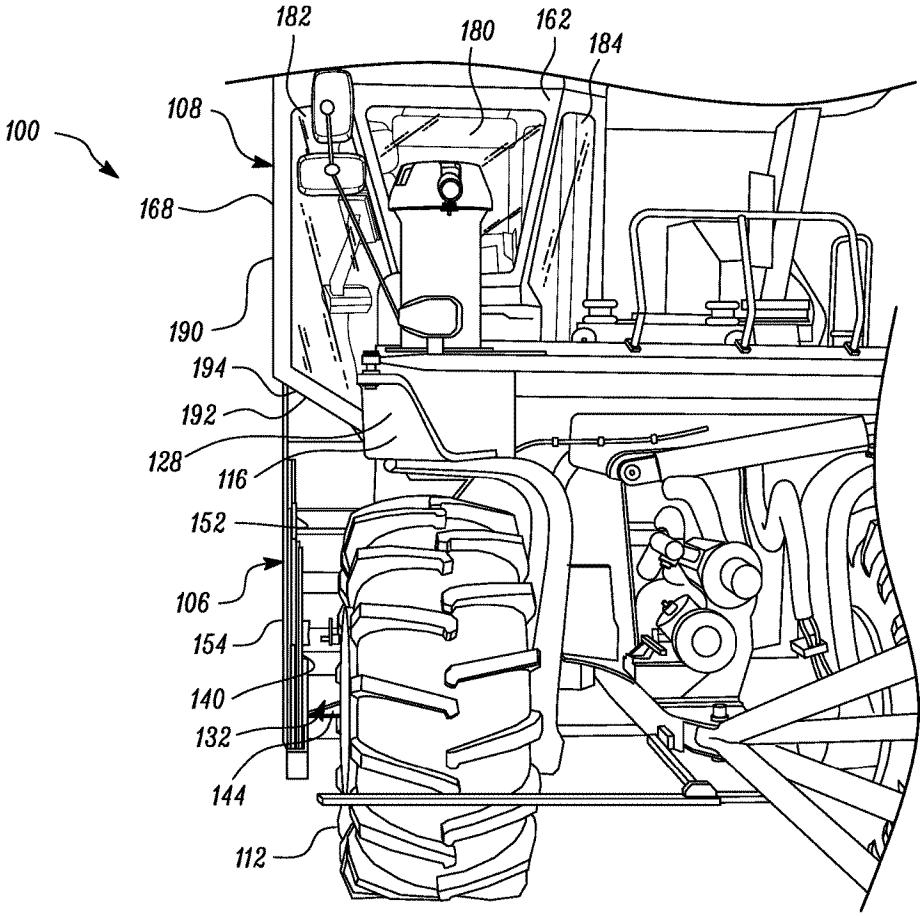
FIG. 7 illustrates a frontal view the milling machine depicting the enclosed operator cabin at the first position, in accordance with an embodiment of the present disclosure.
Figure 8:
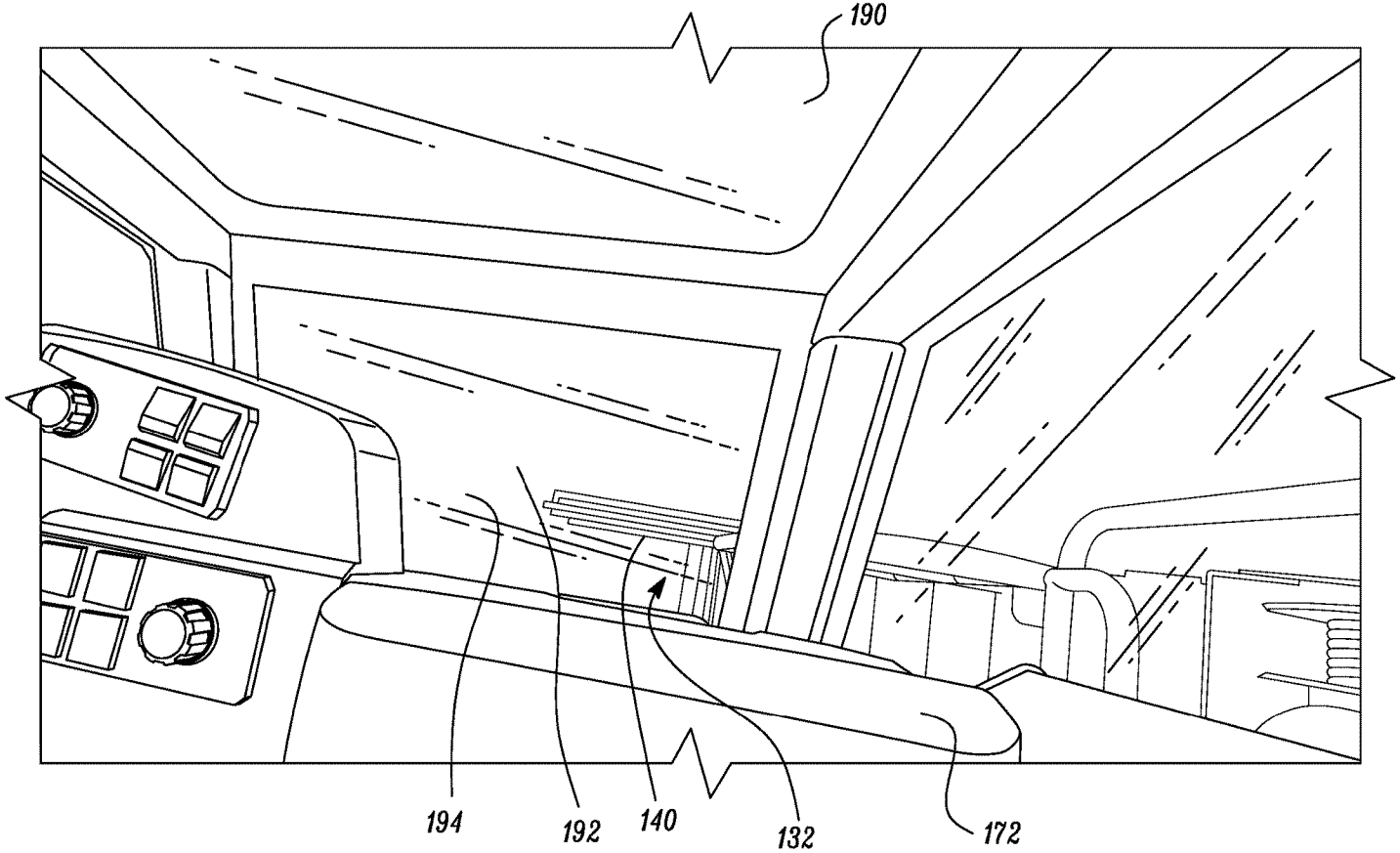
FIG. 8 illustrates a view of the milling chamber of the milling machine, from an interior of the enclosed operator cabin through the viewing window, in accordance with an embodiment of the present disclosure.

In an embodiment, the cab 108 may be slidably mounted on the frame 102. In such a case, the milling machine 100 may include a pair of guide rails 174 that may be disposed at an upper side 176 of the frame 102. In an embodiment, guide rails 174 may be mounted on the frame 102 and engages a front of the cab 108. The cab 108 may include a plurality of wheels (not shown), which are engaged with the guide rails 174 to facilitate a movement/sliding of the cab 108 between a first position (shown in FIG. 3) and a second position (shown in FIG. 4) along the lateral direction of the milling machine 100. The plurality of wheels (not shown) may be coupled to the base structure 166 of the cab 108. In this manner, the plurality of wheels (not shown) and the guide rails 174 engage the base structure 166 with the frame 102. The first position, as shown in FIG. 3, corresponds, approximately, to a rightmost position of the cab 108, while the second position, as shown in FIG. 4, corresponds approximately to a leftmost position of the cab 108. In the first position, a portion of the cab 108 may extend outboard or outwardly of the first lateral side 120 of the frame 102. In an embodiment, in the first position, the first side structure 168, at least partly, may extend outboard/outward of the first lateral side 120 of the frame 102 in the lateral direction of the milling machine 100.

In an embodiment, the cab 108 may be fixedly attached to frame 102. In such case, the cab 108 may be disposed and mounted on the frame 102 at a location that corresponds to the first position. In such a case, the plurality of guide rails 174 and the plurality of wheels (not shown) may be omitted. As the cab 108 is disposed and fixedly attached at the location corresponding to the first position, the cab 108, at least partly, may extend outboard or outwardly of the first lateral side 120 of the frame 102. In such a case, the first side structure 168, at least partly, may extend outwardly or outboard of the first lateral side 120 in the lateral direction of the milling machine 100. The cab 108 or the first side structure 168 extends outboard or outwardly of the first lateral side 120 of the frame 102 to provide a direct line of sight of the milling chamber 132 to the operator of the milling machine 100 seated on the seat 172. In an embodiment, the direct line of sight is provided to the edge 140 of the milling chamber 132.

The roof structure 160, the front structure 162, the back structure 164, the base structure 166, the first side structure 168, and the second side structure 170, are connected to each other to form the enclosed structure of the cab 108. The front structure 162 is configured provide a view of a front of the milling machine 100 and an ambient of the milling machine 100 surrounding the front of the milling machine 100. In a non-limiting embodiment, the front structure 162 may include a front window 180, a first tilted window 182 (shown in FIG. 1), and a second tilted window 184 (shown in FIG. 2). The front window 180 may be disposed between the first tilted window 182 and the second tilted window 184. In one embodiment, the front window 180 is defined in a plane that extends in a lateral direction of the milling machine 100, and the first tilted window 182 and the second tilted window 184 make equal angles with the front window 180. Further, the front structure 162 may extend between the base structure 166 and the roof structure 160 in a vertical direction, and connects the first side structure 168 to the second side structure 170.

The second side structure 170 (shown in FIG. 2 and FIG. 4) may extend from the base structure 166 to the roof 160 in the vertical direction, and may connect the front structure 162 and the back structure 164. The second side structure 170 may include an access door (not shown) for an ingress and egress of the operator into and out the cab 108. The second side structure 170 is disposed on the non-flush cut side 126 of the milling machine 100. The back structure 164 extends from the base structure 166 to the roof 160, in the vertical direction, and connects the first side structure 168 to the second side structure 170.

Referring to FIGS. 1, 3, 6, 7, and 8 the first side structure 168 extends from the base structure 166, and is disposed towards the flush cut side 122 of the milling machine 100. The first side structure 168 connects the back structure 164 to the front structure 162. The first side structure 168 may include a straight portion 190, forming an upper portion of the first side structure 168, and an angled portion 192, forming a lower portion of the first side structure 168. More particularly, the angled portion 192 extends from the base structure 166 to the straight portion 190, and defines a viewing window 194 (best shown in FIGS. 7 and 8) of the cab 108. In an embodiment, the angled portion 192 extends at an angle, A, (shown in FIG. 6) from the base structure 166, and also angled relative to the straight portion 190. In an embodiment, the angle, A, forms an obtuse angle relative to the base structure 166. Further, the angled portion 192 also forms an obtuse angle with the straight portion 190. In an embodiment, the angle, A, may be in a range of 91 degrees to 150 degrees. In certain implementations, the angle, A, may be in a range of 110 degrees to 130 degrees.

The angled portion 192, and therefore, the viewing window 194 is configured to be positioned laterally outside the first lateral side 120 of the frame 102 and is configured to provide a direct line of sight of the milling chamber 132 to the operator seated on the seat 172. In an embodiment, when the cab 108 is positioned at the first position, the viewing window 194 extends outboard of the first lateral side 120 of the milling machine 100. The angled portion 192 in the first position is situated directly above a portion of the milling chamber 132. Thus, the viewing window 194 provides a direct line of sight to the operator seated on the seat 172 of the milling chamber 132 through the gap 136. Therefore, the cab 108, at least partly, is configured to extend outboard of the first lateral side 120 of the frame 102 to facilitate the direct line of sight of the milling chamber 132 to the operator seated on the seat 172 through the viewing window 194. Further, the operator can have the direct line of sight of the milling chamber 132 through the viewing window 194 without swiveling or with a relatively small degree of swiveling of the seat 172. The first side structure 168 may include window panes 196 and corresponding support structures to support the window panes 196. Further, the straight portion 190 may include an auxiliary access door (not shown) of the cab 108.

In an embodiment, the second side structure 170 may be identical to the first side structure 168. In such a case, the second side structure 170 may also include an angled portion, such as the angled portion 192, that may provide a direct line of sight to another edge of the milling chamber 132 (i.e. an edge provided at the non-flush cut side of the milling machine 100) from the cab 108 when the cab 108 is positioned at the second position.

INDUSTRIAL APPLICABILITY

During operation, the milling machine 100 travels along a work path such that it may cut, grind, and/or pulverize the work surface 200 with the rotor 110. A particular work path may extend along or across, for example, an asphalt road or a parking lot. When, during operation, an obstruction such as a curb is encountered, the operator needs to a have clear view of the edge 140 of the milling chamber 132 to enable a precise cut of the work surface 200. To enable such a view, in an embodiment, the operator may slide the cab 108 to the first position. At the first position, the viewing window 194 is positioned laterally outside the first lateral side 120 of the frame 102, and thereby provides the direct line of sight to the edge 140 of the milling chamber 132 to the operator seated in the seat 172. With such a configuration, the operator while seated on the seat 172 is able to see the edge 140 of the milling chamber 132 with a little degree of swivel or no swivel of the seat 172 from the center position. Visual monitoring of the edge 140 of the milling chamber 132 helps in avoiding creation of an unduly large buffer zone of an unprocessed material. Further, as the operator can see the milling chamber 132 and the edge 140 of the milling chamber 132 while sitting, the operator may conduct an inspection of the operation without leaving the seat 172 and without leaving the controls of operation provided within the cab 108.

What is claimed is:

1. A milling machine, comprising:

a frame having a first lateral side that corresponds to a flush cut side of the milling machine, and a second lateral side;

a milling chamber supported by the frame and extending beyond the first lateral side in a lateral direction of the milling machine;

a rotor positioned within the milling chamber to grind a work surface; and an enclosed operator cabin mounted on the frame and controllably positioned to extend at least partly outboard of the first lateral side of the frame such that at least a portion of the enclosed operator cabin being directly above a flush cut side of the milling chamber, the enclosed operator cabin including:

a seat for an operator of the milling machine disposed inside the enclosed operator cabin; and a viewing window positioned laterally outside the first lateral side of the frame and, with reference to the operator seated on the seat when the enclosed operator cabin is positioned to extend at least partially outboard of the first lateral side of the frame, positioned directly above the flush cut side of the milling chamber to permit a direct line of sight through the viewing window to the flush cut side of the milling chamber, the first lateral side of the frame and an edge of the milling chamber forming a laterally extending gap, the direct line of sight including the gap.

2. The milling machine of claim 1, wherein the enclosed operator cabin includes:

a base structure engaged with the frame of the milling machine; and a first side structure extending from the base structure, and disposed towards the flush cut side of the milling machine, the first side structure includes an angled portion defining the viewing window, wherein the angled portion forms an obtuse angle relative to the base structure.

3. The milling machine of claim 1, wherein the enclosed operator cabin is slidably mounted on the frame, and is configured to slide between a first position and a second position along the lateral direction of the milling machine.

4. The milling machine of claim 1, wherein the seat is configured to swivel.

5. The milling machine of claim 1 further including a front end, a rear end, and an engine compartment, the engine compartment being disposed proximate to the rear end, the enclosed operator cabin being positioned proximate to the front end, and the milling chamber being disposed at least partly between the enclosed operator cabin and the engine compartment.

6. The milling machine of claim 1, wherein at least a portion of the milling chamber extends directly below the enclosed operator cabin.

7. The milling machine of claim 1, wherein the second lateral side of the frame corresponds to a non-flush cut side of the milling machine, the milling machine further including a drive assembly for the rotor, wherein the drive assembly is disposed on the non-flush cut side.

8. The milling machine of claim 1, wherein the direct line of sight extends laterally outside of the seat through the viewing window to the gap.

9. The milling machine of claim 1, wherein the viewing window is positioned directly above the flush cut side of the milling chamber such that the direct line of sight extends laterally outside of the seat through the viewing window to the flush cut side of the milling chamber when the enclosed operator cabin is positioned to extend at least partially outboard of the first lateral side of the frame.

10. The milling machine of claim 9, wherein the enclosed operator cabin includes a base structure engaged with the frame of the milling machine, the viewing window forming an angle with the base structure of 91-150 degrees.

11. A milling machine, comprising:

a frame having a first lateral side that corresponds to a flush cut side of the milling machine, and a second lateral side;

a milling chamber supported by the frame and extending beyond the first lateral side in a lateral direction of the milling machine;

a rotor positioned within the milling chamber to grind a work surface; and an enclosed operator cabin slidably mounted on the frame to slide along the lateral direction of the milling machine and extend at least partly outboard of the first lateral side of the frame such that at least a portion of the enclosed operator cabin being directly above a flush cut side of the milling chamber, the enclosed operator cabin including:

a seat for an operator of the milling machine disposed inside the enclosed operator cabin;

a base structure engaged with the frame of the milling machine; and a first side structure extending from the base structure, and disposed towards the flush cut side of the milling machine, the first side structure includes an angled portion defining a viewing window and forming an angle with the base structure of 91-150 degrees, wherein the viewing window is configured to extend outboard of the first lateral side of the frame and, with reference to the operator seated on the seat when the enclosed operator cabin is positioned to extend at least partially outboard of the first lateral side of the frame, positioned directly above the flush cut side of the milling chamber to permit a direct line of sight through the viewing window to the flush cut side of the milling chamber.

12. The milling machine of claim 11 further including a front end, a rear end, and an engine compartment, the engine compartment being disposed proximate to the rear end, the enclosed operator cabin being positioned proximate to the front end, and the milling chamber being disposed at least partly between the enclosed operator cabin and the engine compartment.

13. The milling machine of claim 11, wherein at least a portion of the milling chamber extends directly below the enclosed operator cabin.

14. The milling machine of claim 11, wherein the second lateral side of the frame corresponds to a non-flush cut side of the milling machine, the milling machine further including a drive assembly for the rotor, wherein the drive assembly is disposed on the non-flush cut side.

15. The enclosed operator cabin for a milling machine of claim 11, wherein the first lateral side of the frame and an edge of the milling chamber form a laterally extending gap, the direct line of sight including the gap, and the viewing window is positioned directly above the flush cut side of the milling chamber such that the direct line of sight extends laterally outside of the seat through the viewing window to the flush cut side of the milling chamber when the enclosed operator cabin is positioned to extend at least partially outboard of the first lateral side of the frame.

16. An enclosed operator cabin for a milling machine, the milling machine including a frame having a first lateral side that corresponds to a flush cut side of the milling machine, a milling chamber supported by the frame, and a rotor positioned within the milling chamber to grind a work surface, the enclosed operator cabin comprising:

a base structure configured to be engaged with the frame and controllably position the enclosed operator cabin to extend at least partly outboard of the first lateral side of the frame such that at least a portion of the enclosed operator cabin being directly above a flush cut side of the milling chamber;

a seat for an operator of the milling machine disposed inside the enclosed operator cabin and coupled to the base structure; and a first side structure extending from the base structure, and configured to be disposed towards the flush cut side of the milling machine, the first side structure includes an angled portion defining a viewing window, wherein the angled portion forms an obtuse angle relative to the base structure and, with reference to the operator seated on the seat when the enclosed operator cabin is positioned to extend at least partially outboard of the first lateral side of the frame, positioned directly above the flush cut side of the milling chamber to permit a direct line of sight extending laterally outside of the seat through the viewing window to the flush cut side of the milling chamber.

17. The enclosed operator cabin of claim 16, wherein the enclosed operator cabin is slidably mounted on the frame, and is configured to slide between a first position and a second position along a width of the frame.

18. The enclosed operator cabin of claim 16, wherein the seat is configured to swivel.

19. The enclosed operator cabin of claim 16, wherein the enclosed operator cabin is configured to be mounted on the milling machine such that a portion of the enclosed operator cabin extends directly above the milling chamber.

20. The enclosed operator cabin of claim 16, wherein the viewing window forms an angle with the base structure of 91-150 degrees.

* * * * *